US008955437B2

(12) United States Patent
Izume

(10) Patent No.: US 8,955,437 B2
(45) Date of Patent: Feb. 17, 2015

(54) PRINTING MACHINE

(76) Inventor: Masayuki Izume, Kyoto (JP)

( * ) Notice: Subject to any disclaimer, the term of this patent is extended or adjusted under 35 U.S.C. 154(b) by 1463 days.

(21) Appl. No.: 11/887,364

(22) PCT Filed: Mar. 29, 2006

(86) PCT No.: PCT/JP2006/306434
§ 371 (c)(1),
(2), (4) Date: Sep. 14, 2009

(87) PCT Pub. No.: WO2006/104191
PCT Pub. Date: Oct. 5, 2006

(65) Prior Publication Data

US 2009/0320703 A1 Dec. 31, 2009

(30) Foreign Application Priority Data

Mar. 29, 2005 (JP) ..... 2005-095346

(51) Int. Cl.
*B41F 31/08* (2006.01)
*B41F 31/02* (2006.01)
*B41F 31/04* (2006.01)

(52) U.S. Cl.
CPC ..... *B41F 31/08* (2013.01); *B41F 31/022* (2013.01); *B41F 31/04* (2013.01)
USPC ..... 101/366; 101/364; 101/350.1

(58) Field of Classification Search
USPC ..... 101/364, 366, 367, 350.1; 222/633
See application file for complete search history.

(56) References Cited

U.S. PATENT DOCUMENTS 3,199,451 A * 8/1965 Nitchie ..... 101/366
4,314,658 A * 2/1982 Laauwe ..... 222/213
5,333,761 A * 8/1994 Davis et al. ..... 222/212
5,823,110 A * 10/1998 Izume ..... 101/352.09

(Continued)

FOREIGN PATENT DOCUMENTS

DE 19908841 A1 10/1999
DE 296 23 860 U1 4/2000

(Continued)

OTHER PUBLICATIONS

Supplementary European Search Report for European Patent Application No. 06730382.6 dated Dec. 20, 2010.

*Primary Examiner* — Daniel J Colilla
*Assistant Examiner* — Leo T Hinze
(74) *Attorney, Agent, or Firm* — Edwards Wildman Palmer LLP; James E. Armstrong, IV; George N. Chaclas

(57) ABSTRACT

A printing machine in which automatic supply of ink from different types of ink container to the ink fountain is possible, and in which further automation of replacement procedure, simplification of replacement procedure, and reduction of time required for replacement procedure are achieved is provided. The printing machine comprises an ink fountain member 2 having fountain-forming faces forming an ink fountain 1; an ink fountain roller 3 for applying an ink to the outer peripheral surface through an ink channel between the ink fountain roller 3 and the ink fountain member 2; a plurality of rollers 4, 15 for supplying the ink applied to the outer peripheral surface of the ink fountain roller 3 to a printing portion; a plurality of ink containers 65, accommodating different types of ink, and being stored in a predetermined container storage unit 66; and an ink supply device 68 for holding the desired ink container 65 and supplying the ink therein to the ink fountain 1.

24 Claims, 10 Drawing Sheets

(56) References Cited

U.S. PATENT DOCUMENTS

| | | | | | |
|---|---|---|---|---|---|
| 5,839,368 | A | * | 11/1998 | Ohinata | 101/364 |
| 5,894,967 | A | * | 4/1999 | Stahley et al. | 222/633 |
| 5,918,767 | A | * | 7/1999 | McGill | 222/95 |
| 5,974,970 | A | * | 11/1999 | Izume | 101/350.1 |
| 5,979,326 | A | * | 11/1999 | Ohinata | 101/494 |
| 6,085,652 | A | * | 7/2000 | Deschner et al. | 101/366 |
| 6,220,160 | B1 | * | 4/2001 | Weber et al. | 101/350.1 |
| 6,269,744 | B1 | | 8/2001 | Blaser et al. | |
| 6,619,206 | B2 | * | 9/2003 | Koehler | 101/364 |
| 2002/0152907 | A1 | | 10/2002 | Koehler | |
| 2004/0089174 | A1 | * | 5/2004 | Ghisalberti et al. | 101/210 |

FOREIGN PATENT DOCUMENTS

| | | | |
|---|---|---|---|
| JP | 52-144002 | | 11/1977 |
| JP | 02233253 | A | 9/1990 |
| JP | 5-44845 | | 6/1993 |
| JP | 3194174 | | 3/1995 |
| JP | 09-193356 | | 7/1997 |
| JP | 11-320837 | | 11/1999 |
| WO | WO-00/10810 | A1 | 3/2000 |

* cited by examiner

PRINTING MACHINE

CROSS REFERENCE TO RELATED APPLICATIONS

This application is related to three co-pending applications: "UNIT OF A PLURALITY OF DIVIDED VIBRATING ROLLERS AND PRINTING MACHINE" filed even date herewith in the names of Masayuki Izume as a national phase entry of PCT/JP2006/306428; "PRINTING MACHINE" filed even date herewith in the name of Masayuki Izume as a national phase entry of PCT/JP2006/306430; and "PRINTING MACHINE" filed even date herewith in the name of Masayuki Izume as a national phase entry of PCT/JP2006/306426; which applications are assigned to the assignee of the present application and all three incorporated by reference herein.

TECHNICAL FIELD

The present invention relates to a printing machine.

BACKGROUND ART

In the usual printing machine, an ink fountain roller is arranged close to an ink fountain member forming an ink fountain, ink applied to the outer peripheral surface of the ink fountain roller from the ink fountain is transferred to an ink distributing roller by a vibrating roller, and the ink is further supplied to the printing surface of the printing portion via a plurality of other ink distributing rollers.

Conventionally, the ink fountain member has a plate shape, and the ink in the ink fountain is applied to the outer peripheral surface of the ink fountain roller through an ink channel defined by the ink fountain member and the ink fountain roller.

In such printing machine, the type of ink to use sometimes needs to be changed depending on the content of printing, in which case, the replacement procedure of changing the ink in the ink fountain for that to be used for the next printing is performed after the previous printing is completed. The replacement procedure includes collecting old ink in the ink fountain as well as cleaning the ink fountain member and each roller.

In the conventional printing machine, the vibrating roller and the ink distributing roller are automatically cleaned by a so-called inker cleaning, but the ink fountain roller and the ink fountain member are cleaned manually in the following manner since automation of cleaning is difficult to perform thereon. After the previous printing is completed, the old ink remaining in the ink fountain is taken out manually with the rotation of the ink fountain roller stopped, and the portion of the ink fountain roller and the ink fountain member that have contacted the ink is cleaned by hand. Thus, the collecting old ink and the cleaning works are troublesome, and furthermore, the replacement procedure requires time since the ink fountain member and the ink fountain roller must be cleaned by hand, whereby a long time is required until the next printing can be started.

Furthermore, the size (width) of the ink channel sometimes needs to be changed depending on the content of printing, in which case, the size of the ink channel is adjusted by changing the position or the angle of the ink fountain member in the prior art, but such adjustment is also troublesome.

The inventor of the present invention thus proposed the printing machine disclosed in patent document 1.

The printing machine includes an ink fountain member having fountain-forming faces; an ink fountain roller for applying the ink to its outer peripheral surface through the ink channel between the ink fountain roller and the ink fountain member; a plurality of rollers for supplying the ink applied to the outer peripheral surface of the ink fountain roller to the printing portion; a strip of sheet placed over the ink fountain member so as to cover the fountain-forming face with the middle part closely attached thereto; a sheet moving device for moving the strip of sheet in the length direction thereof; a pair of barrier plates attracted to the fountain-forming face from above the sheet and attracted to the outer peripheral surface of the ink fountain roller by a permanent magnet to form side plates of the ink fountain; a cleaning tank arranged close to and blow the ink fountain roller; a cleaning blade arranged in the cleaning tank; and a reciprocating device for switching the cleaning blade between a cleaning position of being in pressing contact with the outer peripheral surface of the ink fountain roller and a stand-by position of being away from the ink fountain roller. The ink fountain member is turned by a turning device to be positioned at one of a plurality of work positions, where a plurality of fountain-forming faces on which an ink channel-defining portion at the distal end comes close to the ink fountain roller and forms the ink fountain when positioned at each work position are formed at the periphery of the ink fountain member in the turning direction of the ink fountain member, and the distance from the central axis of rotation of the ink fountain member to each ink channel-defining portion differs from each other.

Patent document 1: Japanese Patent Publication No. 3194174

DISCLOSURE OF THE INVENTION

Problems to be Solved by the Invention

The replacement procedure can be simplified compared to the prior art and the working time can be reduced in the above described printing machine.

However, the replacement of the old barrier plate by the new barrier plate, supply of new ink to the ink fountain and the like cannot be automatically performed, and thus simplification of the replacement procedure and reduction in the working time are not adequate.

Since the barrier plate is strongly attracted to the fountain-forming face and the outer peripheral surface of the ink fountain roller by the permanent magnet, automatic replacement thereof is difficult. In the case where the barrier plate is attracted to the fountain-forming face and the outer peripheral surface of the ink fountain roller with use of electromagnet, the barrier plate can be easily and automatically replaced by stopping the current flow to the electromagnet. However, in such case, the current must be constantly flowed to the electromagnet during printing, where heat generation of the electromagnet and adverse effects thereof are significant, and thus there is no other choice but to use the permanent magnet.

Furthermore, it is difficult to automatically supply the ink in a metal can and the like into the ink fountain.

Moreover, when printing in large amounts, the ink in the ink fountain may degrade during printing and adversely effect the printing quality since the desired ink is placed in great amount all at once in the ink fountain. Furthermore, the old ink sometimes remains in great amounts in replacement, in which case, the remaining ink becomes a waste, and furthermore, a great amount of time is required to collect the remaining ink.

In view of solving the above problems, an object of the present invention is to provide a printing machine in which automatic supply of ink from different types of ink container to the ink fountain is possible, and in which further automation of replacement procedure, simplification of replacement procedure, and reduction of time required for the procedure are achieved.

Means for Solving the Problems

The printing machine of claim 1 comprises an ink fountain member having a fountain-forming face forming an ink fountain; an ink fountain roller for applying an ink to an outer peripheral surface through an ink channel between the ink fountain roller and the ink fountain member; a plurality of rollers for supplying the ink applied to the outer peripheral surface of the ink fountain roller to a printing portion; a plurality of ink containers, accommodating different types of ink, and being stored in a predetermined container storage unit; and an ink supply device for holding the desired ink container and supplying the ink therein to the ink fountain.

In time of replacement procedure, supply of ink from different types of ink container to the ink fountain is automatically performed by the ink supply device, whereby automation of the replacement procedure, simplification of the replacement procedure, and reduction in time required for the replacement procedure are achieved.

The printing machine of claim 2, which is according to claim 1, is characterized in that the ink supply device, comprising a level sensor for detecting the level of ink in the ink fountain, detects the level of ink in the ink fountain and supplies the ink to the portion of the ink fountain where the level of ink is lower than a predetermined value during printing operation.

In this case, the level of the ink in the ink fountain is maintained substantially constant during printing. Thus, a great amount of ink does not need to be placed in the ink fountain as in the prior art, and the level of ink in the ink fountain may be low so that the amount of ink to be placed in the ink fountain is small. The ink in the ink fountain is thus prevented from deteriorating and adversely affecting the printing quality. Furthermore, the amount of ink that becomes a waste in time of replacement is reduced, and the time required for collecting the remaining ink is reduced.

The printing machine of claim 3, which is according to claim 1, is characterized in that the ink container has a bellows shape compressible in the vertical direction, a slit-like aperture that is normally closed is formed at a bottom wall of the container, and the portion of the slit-like aperture is opened by pressure when the upper portion of the ink container is pressed downward while holding the bottom portion of the ink container, so that the ink in the ink container passes through the opened slit-like aperture portion and drops downward.

In this case, the ink is supplied to the ink fountain by simply moving the ink container above the ink fountain, and pushing the upper portion of the ink container. Therefore, the automation of supply of ink from the ink container to the ink fountain is simplified.

The printing machine of claim 4, which is according to claim 3, is characterized in that the ink supply device comprises a moving body that moves above the ink fountain in a direction parallel to the ink fountain roller, container holders disposed on the moving body for holding and releasing the portion including the bottom of the ink container, and a pressing member disposed on the moving body for pushing downward the upper portion of the ink container held by the container holding members.

In this case, the desired ink container can be held and moved by the container holding members, and the desired ink can be supplied to the ink fountain by simply moving the desired ink container above the ink fountain and pressing the upper portion of the ink container with the pressing member. Therefore, automation of supply of ink from different ink containers to the ink fountain is simplified.

The printing machine of claim 5, which is according to claim 4, is characterized in that a level sensor for detecting the level of ink in the ink fountain is disposed in the moving body, the moving body moving above the ink fountain in a direction parallel to the ink fountain roller, detecting the level of ink in the ink fountain, and supplying the ink to the portion of the ink fountain where the level of ink is lower than a predetermined value during printing operation.

In this case, the level of ink in the ink fountain is maintained substantially constant during printing. Thus, a great amount of ink does not need to be placed in the ink fountain as in the prior art, and the level of ink in the ink fountain may be low so that the amount of ink to be placed in the ink fountain is small. The ink in the ink fountain is thus prevented from deteriorating and adversely affecting the printing quality. Furthermore, the amount of ink that becomes a waste in time of replacement is reduced, and the time required for collecting the remaining ink is reduced.

Effect of the Invention

According to the printing machine of claim 1, supply of ink from different types of ink container to the ink fountain is automatically performed, whereby further automation of the replacement procedure, simplification of the replacement procedure, and reduction in time required for the replacement procedure are achieved, as described above.

According to the printing machine of claim 2, the level of ink in the ink fountain is maintained substantially constant and the amount of ink to be placed in the ink fountain is reduced during printing, whereby the ink in the ink fountain is prevented from deteriorating and adversely affecting the printing quality, and furthermore, the amount of ink that becomes a waste in time of replacement is reduced and the time required for collecting the remaining ink is reduced, as described above.

According to the printing machine of claim 3, automation of supply of ink from the ink container to the ink fountain is simplified, as described above.

According to the printing machine of claim 4, automation of supply of ink from different ink containers to the ink fountain is simplified, as described above.

According to the printing machine of claim 5, the level of ink in the ink fountain is maintained substantially constant and the amount of ink to be placed in the ink fountain is reduced during printing, whereby the ink in the ink fountain is prevented from deteriorating and adversely affecting the printing quality, and furthermore, the amount of ink that becomes a waste in time of replacement is reduced and the time required for collecting the remaining ink is reduced, as described above.

BRIEF DESCRIPTION OF THE DRAWINGS

The invention, together with objects and advantages thereof, may best be understood by reference to the following description of the presently preferred embodiment together with the accompanying drawings in which.

Figure 1:
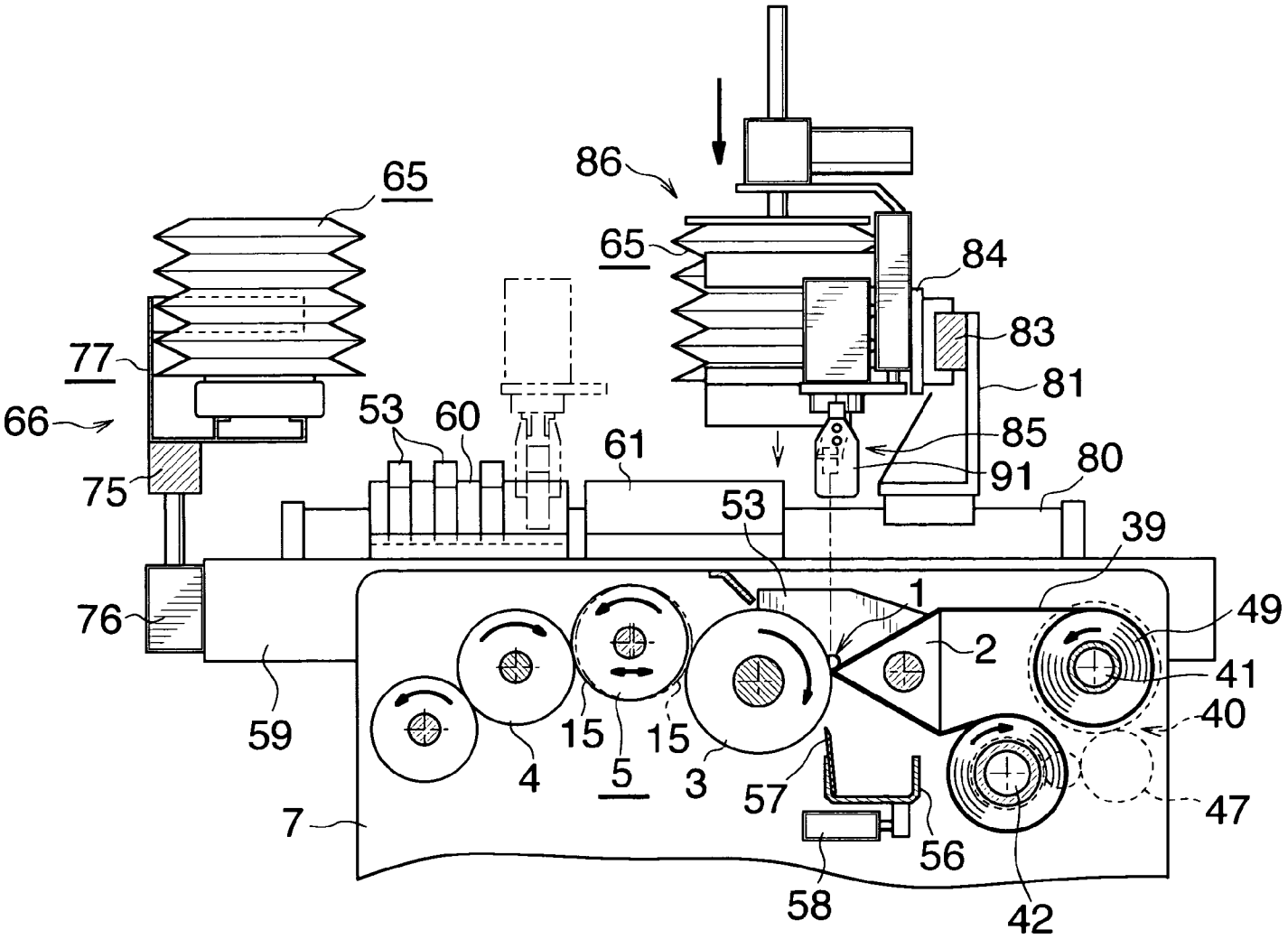
FIG. 1 is a schematic side view of the main parts of an inking arrangement of a printing machine.

DESCRIPTION OF SYMBOLS (1) ink fountain
(2) ink fountain member
(3) ink fountain roller
(4) ink distributing roller
(37*a*)(37*b*)(37*c*) fountain-forming face
(38*a*)(38*b*)(38*c*) ink channel-defining portion
(52) ink channel
(65) ink container
(72) bottom plate
(73) slit-like aperture
(84) moving body
(86) ink supply device
(93) container holding members
(99) pressing member
(101) level sensor
(104) ink fountain member
(105*a*)(105*b*)(105*c*)(105*d*) fountain-forming face
(106*a*)(106*b*)(106*c*)(106*d*) ink channel-defining portion
(107) ink fountain member
(108) fountain-forming face
(109) ink channel-defining portion

BEST MODE FOR CARRYING OUT THE INVENTION

The embodiment of the present invention will now be described with reference to the drawings.

Figure 2:
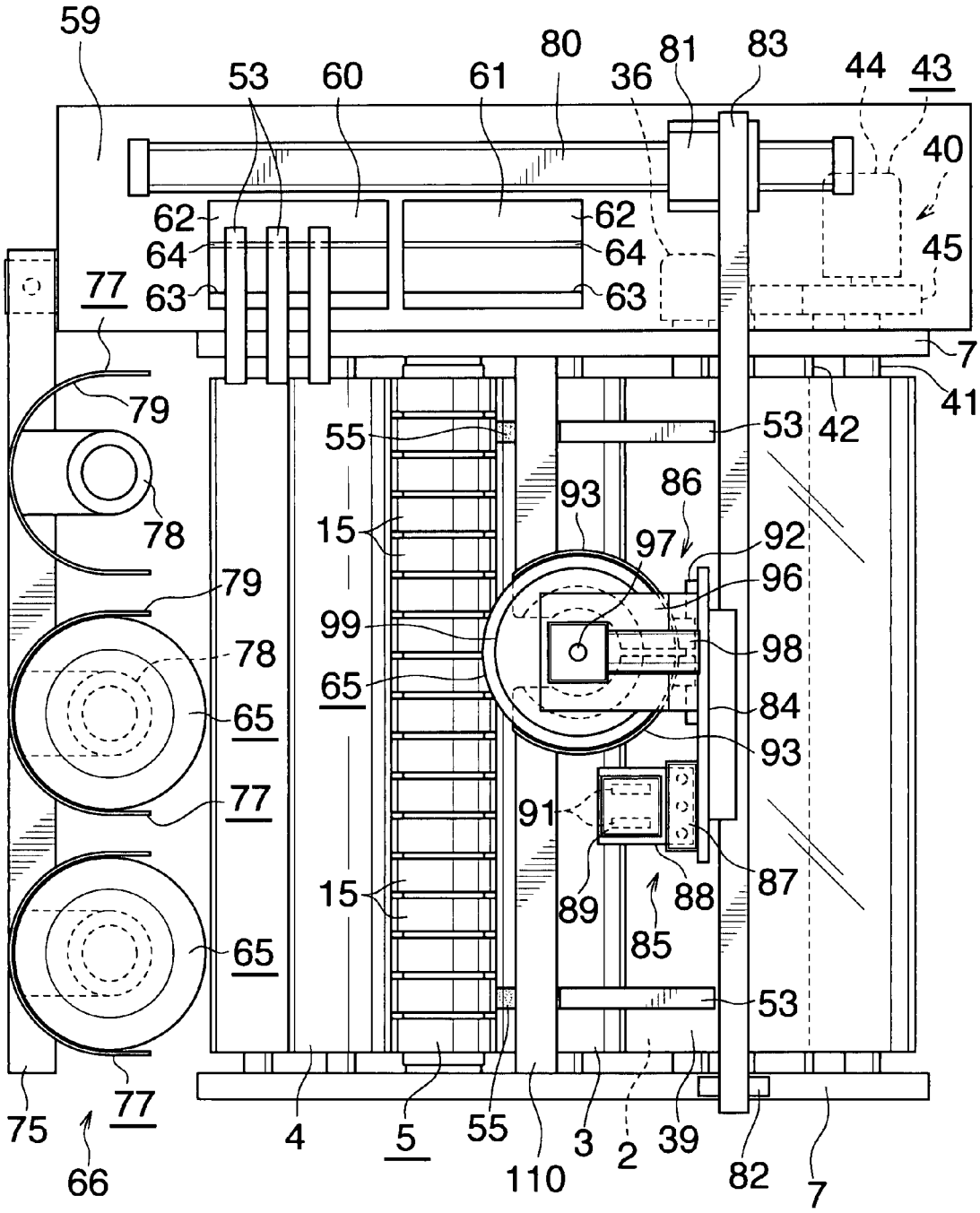
FIG. 2 is a plane view of FIG. 1.

FIG. 1 is a left side view schematically showing one part of an inking arrangement of the printing machine, and FIG. 2 is a plane view of the same. In the following description, the right side of FIGS. 1 and 2 is the front, the left side is the back, and the right and left sides when seen from the front is the right and the left.

In FIGS. 1 and 2, a first ink distributing roller (4) of the plurality of ink distributing rollers is arranged behind an ink fountain roller (3) close to the back end of an ink fountain member (2) forming an ink fountain (1), and a unit (5) of a plurality of divided vibrating rollers is arranged between the fountain roller (3) and the distributing roller (4). The axes of the fountain roller (3) and the distributing roller (4) are parallel to each other and extend in the right-left direction. The fountain roller (3) and the distributing roller (4) are rotatably supported by a frame (7) of the printing machine, and are rotated in the direction of arrows as shown in FIG. 1 at a predetermined rotation speed by an unillustrated driving device. The rotation speed of the fountain roller (3) is about 1/10 of that of the distributing roller (4).

Figure 3:
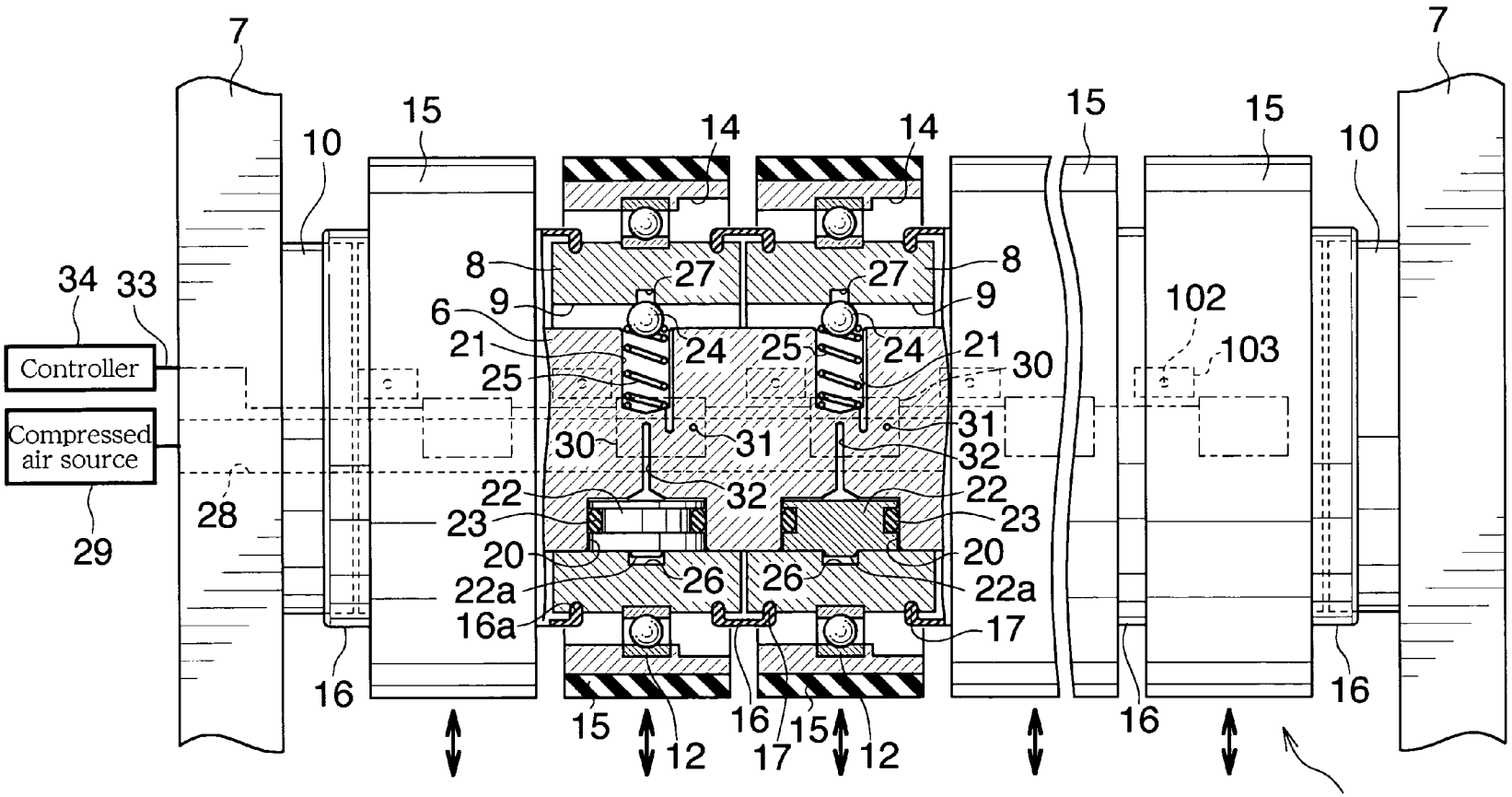
FIG. 3 is a partially cut-out plane view of a portion of a unit of a plurality of divided vibrating rollers.
Figure 4:
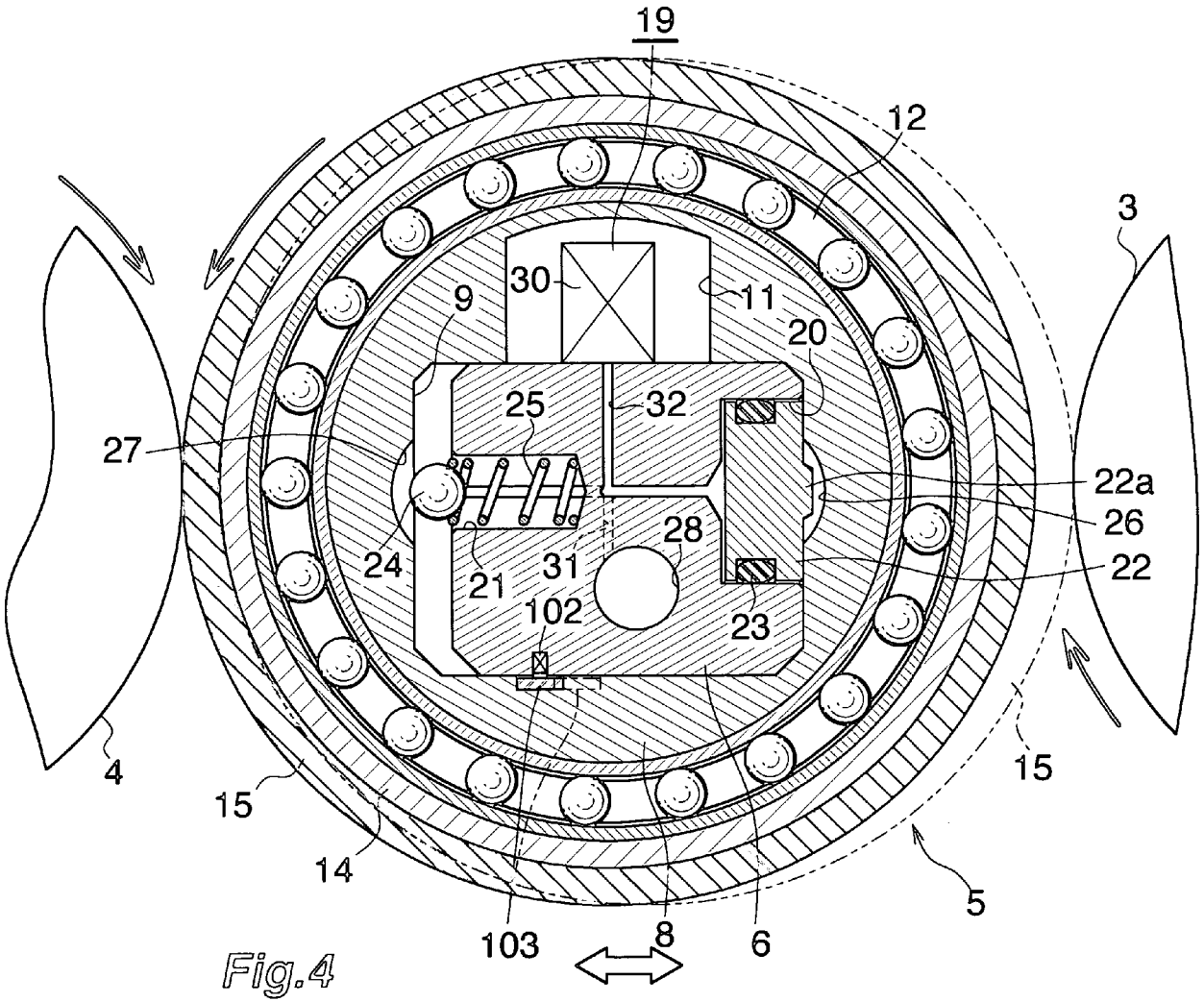
FIG. 4 is a traverse cross sectional view of FIG. 3.

The details of the vibrating-roller unit (5) are shown in FIGS. 3 and 4. FIG. 3 is a partially cut-out plane view of the vibrating-roller unit (5), where the lower side of the figure is the front and the upper side is the back. FIG. 4 is an enlarged traverse cross sectional view of one part of FIG. 2 seen from the left side.

Both right and left ends of a linear support member (6) parallel to the rollers (3), (4) are fixed to the frame (7) and a plurality of movable members (8) are attached to the periphery of the support member (6). The support member (6) has a prism column shape with the front-to-back width being slightly larger than the top-to-bottom width. The movable member (8) has a short circular cylinder shape, and a relatively large rectangular bore (9) is formed in the movable member (8) passing therethrough in the axis direction. The plurality of movable members (8) are arranged in the axis direction between a pair of opposed short cylindrical fixed members (10), which are fixed to the frame (7) so as to face each other and passed through by the support member (6), and the support member (6) passes through the bores (9) of the movable members (8). The top-to-bottom width of the bores (9) of the movable members (8) is substantially the same as the top-to-bottom width of the support member (6), and both upper and lower surfaces of the bore (9) slidably contact the upper and lower surfaces of the support member (6). The front-to-back width of the bore (9) is slightly larger than the front-to-back width of the support member (6), so that the movable member (8) moves back and forth with respect to the support member (6) between a front end position where the rear surface of the bore (9) contacts the rear surface of the support member (6) and a back end position where the front surface of the bore (9) contacts the front surface of the support member (6). A rectangular groove (11) is formed over the entire length of the movable member (8) on the upper surface of the bore (9) of the movable member (8) that slidably contacts the support member (6).

Each movable member (8) is positioned in the axis direction with respect to the support member (6), as hereinafter described, and a slight gap is formed in the axis direction between the adjacent movable members (8) and between the movable members (8) at both ends and the fixed members (10) at both ends respectively. Each movable member (8) thus moves individually in the front-back direction with respect to the support member (6).

An inner ring of a ball bearing (12), which is a rolling bearing, is fixed at the outer periphery of each movable member (8). A metal sleeve (14) is fixed to the outer periphery of the outer ring of each ball bearing (12), and a vibrating roller (15) of thick walled cylinder shape made of rubber is fixed to the outer periphery of the sleeve (14).

A dustproof member (16) of short circular cylinder shape is fitted to cover the outer peripheries between the adjacent movable members (6). The dustproof member (16) is made by an appropriate rubberlike elastic material such as natural rubber, synthetic rubber, and synthetic resin, and flange portions (16*a*) that slightly protrude towards the inner side are integrally formed at both ends. The dustproof member (16) is fixed to the movable member (8) by fitting the flange portions (16*a*) to annular grooves (17) formed in the outer peripheral surface of the portion closer to right and left ends of the movable member (8). The dustproof member (16) is similarly fitted to cover the outer peripheries between the movable members (8) at right and left ends and the fixed members (10) adjacent thereto respectively.

A change-over device (19) for switching the position of the vibrating roller (15) is arranged on the support member (6) side between each movable member (8) and the support member (6) in the following manner.

At the portion of the support member (6) corresponding to the central part in the axial direction of the movable member (8), a cylinder portion (20) is formed by forming a hole extending slightly to the back side from the front surface, and a spring cavity (21) extending slightly to the front side from the back side is also formed. The center of the cylinder portion (20) and the center of the spring cavity (21) are on one line extending in the front-back direction in the vicinity of the center in the top-to-bottom direction of the movable member (8). A piston (22) of short circular cylinder shape is inserted into the cylinder portion (20) by way of an O-ring (23) so as to be slidable in the front-back direction. A ball (24) serving as a biasing member is inserted to the spring cavity (21) so as to be slidable in the front-back direction, and a compression coil spring (25) for biasing the same in the backward direction is also inserted thereinto.

Recesses (26), (27) are respectively formed at the front surface of the bore (9) of the movable member (8) facing the center of the piston (22) and the rear surface of the bore (9) facing the center of the ball (24). The width in the axial direction of the movable member (8) of each recess (26), (27) is constant. The cross sectional shape of each recess (26), (27) at the cross section orthogonal to the axis line of the movable member (8) is uniform, and has a circular arc shape having a line parallel to the axis line as the center. A tapered projection (22*a*) is formed at the center of the end face of the piston (22) facing the recess (26), and the projection (22*a*) is fitted into the recess (26). The length of the portion excluding the projection (22*a*) of the piston (22) is slightly shorter than the length of the cylinder portion (20), and the most part of the projection (22*a*) projects out from the front surface of the support member (6) even if the piston (22) is inserted farthest into the cylinder portion (20). Part of the outer periphery of the ball (24) is fitted to the recess (27).

At the back part of the support member (6), the ball (24) is constantly pressed against the rear surface of the bore (9) of the movable member (8) by the elastic force of the spring (25), and part of the outer periphery of the ball (24) is fitted to the recess (27) and pressed against the front and back rims of the recess (27). At the front part of the support member (6), on the other hand, the front surface of the support member (6) or the piston (22) is pressed against the front surface of the bore (9) of the movable member (8), and the most part of the projection (22*a*) of the piston (22) is fitted to the recess (26). The positioning in the axis direction of the movable member (8) with respect to the support member (6) is performed as the most part of the projection (22*a*) of the piston (22) and one part of the ball (24) are constantly fitted to the recesses (26), (27).

An air supply channel (28) is formed in the support member (6) extending from the left end thereof in the axial direction and closing near the right end, and the open end at the left end of the channel (28) is connected to a compressed air source (29) by way of an appropriate piping.

A switching valve (solenoid valve) (30) is attached to the upper surface of the support member (6) facing the groove (11) of the movable member (8), and the two ports of the valve (30) are respectively communicated to the air supply channel (28) and the cylinder portion (20) by way of communicating channels (31), (32) formed in the support member (6). An electric wire (33) of the valve (30) is led to the outside through the groove (11) portion, and is connected to a controller (34).

The cylinder portion (20) is communicated to the air supply channel (28) by way of the valve (30) when the valve is in an energized state (on state), and the cylinder portion (20) is communicated to atmospheric air by way of the valve (30) when the valve is in an unenergized state (off state). The position in the front-back direction of each vibrating roller (15) is individually switched by individually switching the state of current flow to the valve (30) of each change-over device (19) with the controller (34).

When the valve (30) is switched to the off state, the cylinder portion (20) is communicated to atmospheric air, and thus the piston (22) is able to freely move inside the cylinder portion (20). The movable member (8) is thus moved to the back side through the ball (24) by the spring (25). Consequently, the movable member (8) and the vibrating roller (15) are switched to the back end position, and the vibrating roller (15) moves away from the fountain roller (3) and presses against the distributing roller (4).

When the valve (30) is switched to the on state, the cylinder portion (20) is communicated to the air supply channel (28) and further to the compressed air source (29) therethrough, and thus compressed air is supplied to the cylinder portion (20). The piston (22) thus projects forward from the support member (6) against the force of the spring (25), whereby the movable member (8) is moved forward. Consequently, the movable member (8) and the vibrating roller (15) are switched to the front end position, and the vibrating roller (15) moves away from the distributing roller (4) and presses against the fountain roller (3).

A change-over detection sensor (102) comprising a magnetic sensor is fixed in an embedded manner at the lower surface of the support member (6) that slidably contacts the bottom wall of the bore (9) of the movable member (8), and a permanent magnet (103) is fixed in an embedded manner at the bottom wall of the bore (9) of the movable member (8) facing thereto. The lower surface of the sensor (102) is in plane with the lower surface of the support member (6), or is positioned slightly inward (upper side). The upper surface of the permanent magnet (103) is in plane with the bottom wall surface of the bore (9) of the movable member (8), or is positioned slightly inward (lower side). The sensor (102) faces the central part in the front-back direction of the permanent magnet (103) when the movable member (8) is switched to the back end position, and the sensor (102) is deviated backwards from the permanent magnet (103) when the movable member (8) is switched to the front end position. Therefore, the output of the sensor (102) changes depending on the position of the movable member (8), and which position the movable member (8), that is, the vibrating roller (15) is at is recognized from the output of the sensor (102).

As hereinafter described, the ink applied to the outer peripheral surface of the fountain roller (3) from the ink fountain (1) is transferred to the vibrating roller (15) while the vibrating roller (15) is switched to the front end position, and the ink transferred to each vibrating roller (15) is transferred to the distributing roller (4) while the vibrating roller (15) is switched to the back end position. The ink transferred to the distributing roller (4) is further supplied to the printing surface through a plurality of other ink distributing rollers and the like. The amount of ink supplied to the printing surface is adjusted by the position in the width direction by controlling the time switched to the front end position and the back end position for each vibrating roller (15) with the controller (34).

Whether or not the switching of the position of the vibrating roller (15) is normal is detected by the output of the sensor (102), and a warning is given if the vibrating roller (15) is not normally switched.

Figure 5:
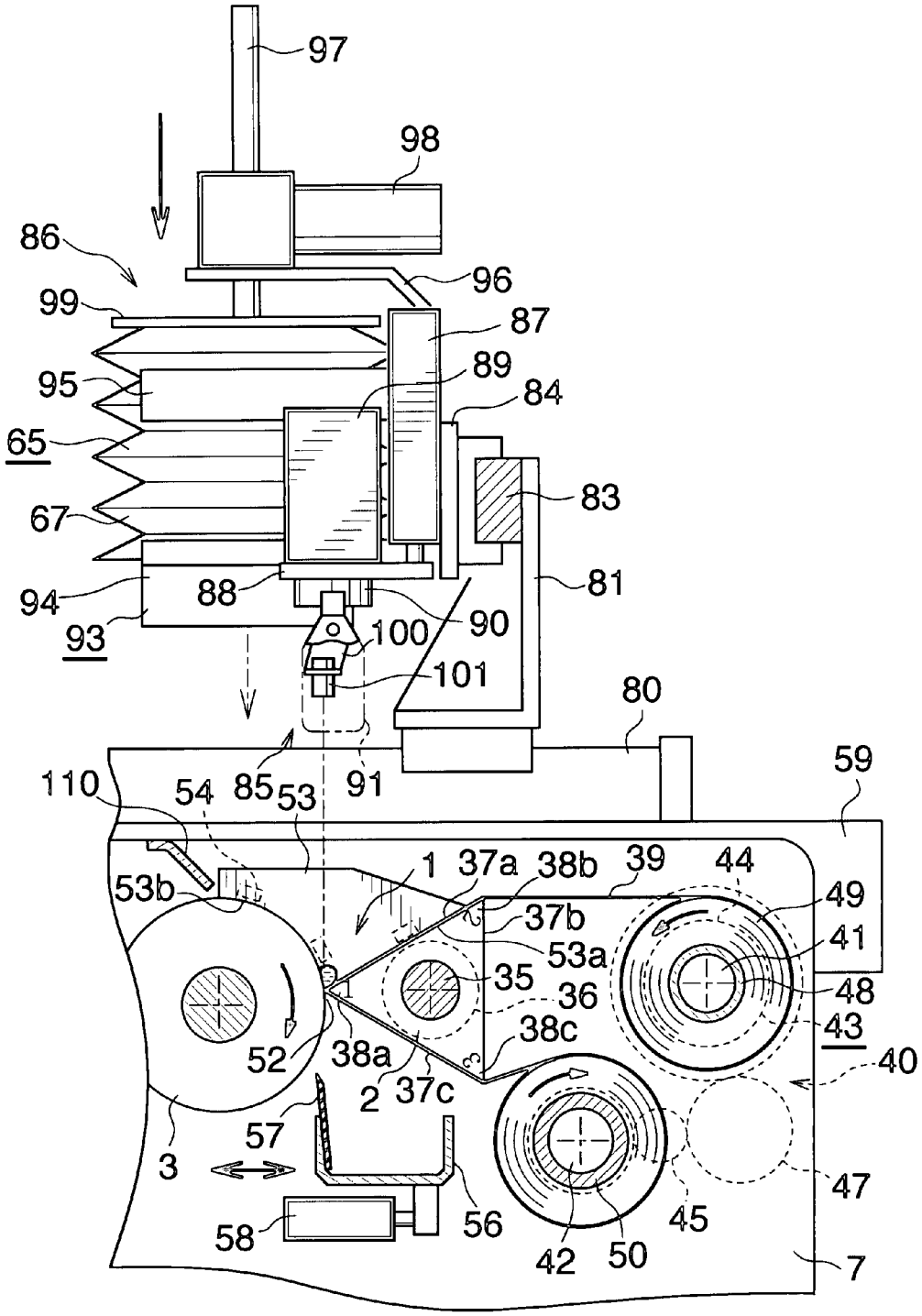
FIG. 5 is a view showing one part of FIG. 1 in an enlarged manner.
Figure 6:
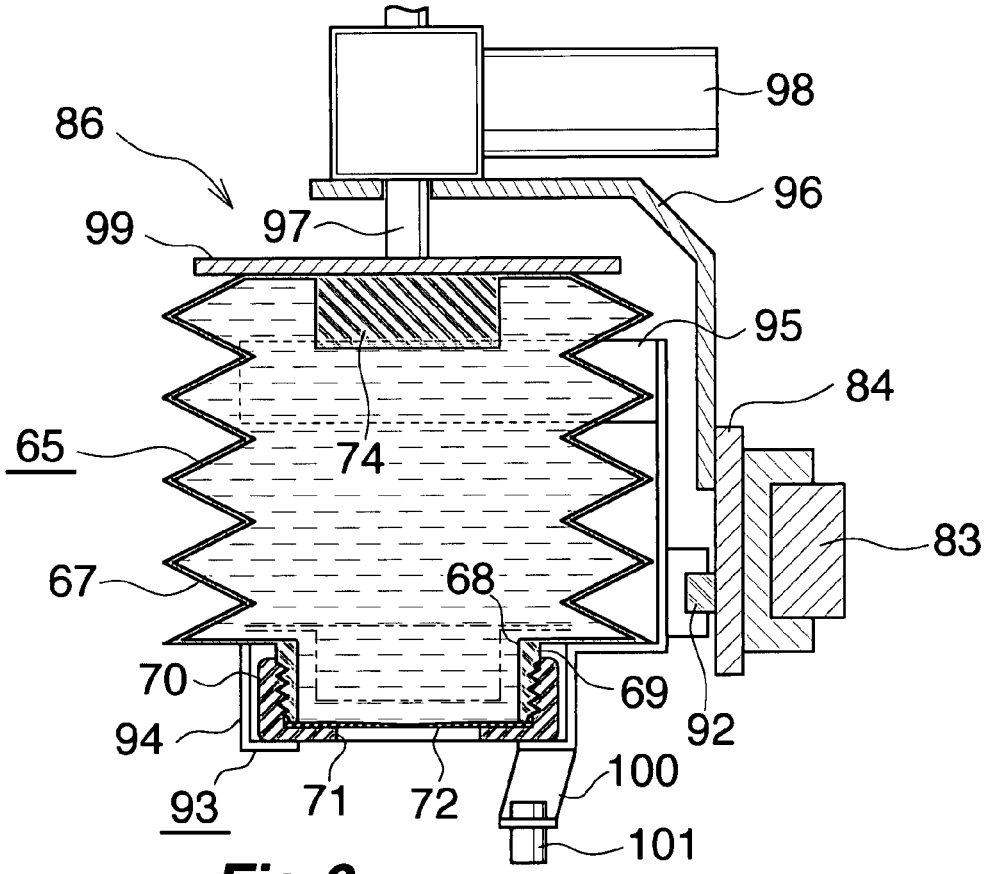
FIG. 6 is a longitudinal cross sectional view showing an ink container and the portion of the ink supply device.
Figure 7:
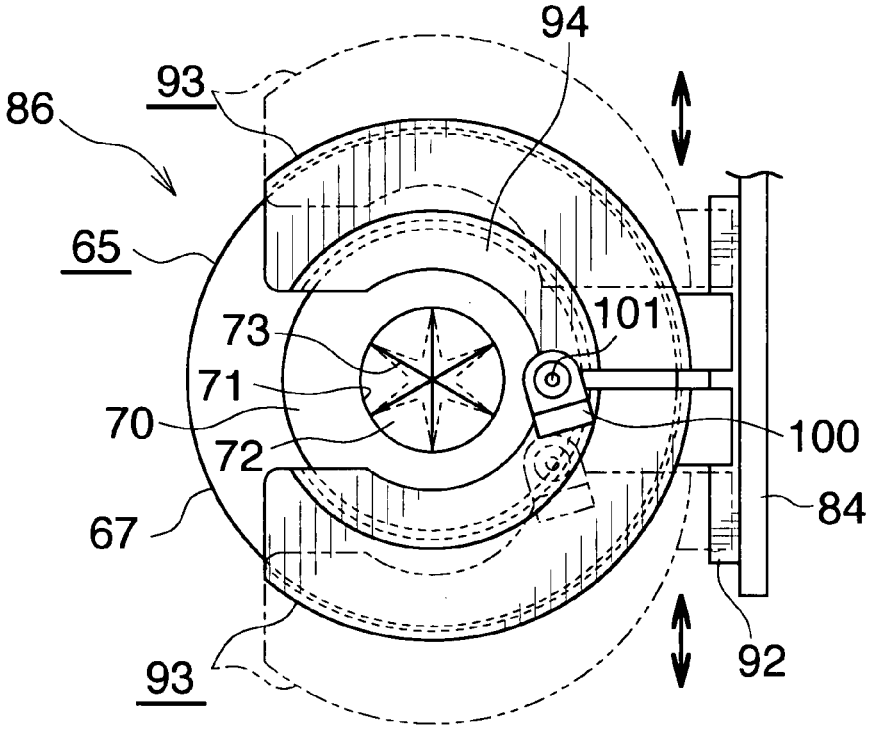
FIG. 7 is a bottom view of FIG. 6.

FIG. 5 is a view showing part of FIG. 1 in an enlarged manner, and FIGS. 6 to 10 are views showing each part of the ink supply device in detail.

The ink fountain member (2) has a triangular prism shape having a cross section of an equilateral triangle and the like, and a support shaft portions (35) of circular cylinder shape arranged on both right and left ends are rotatably supported by the frame (7). An ink fountain member turning device (36) comprising an electric motor is arranged in the frame (7), and the ink fountain member (2) is turned, positioned at one of three work positions at an angular spacing of 120 degrees, and fixed at each work position by the turning device (36).

The three side surfaces of the periphery of the ink fountain member (2) serve as fountain-forming faces (37*a*), (37*b*), (37*c*), and the ridge lines at the ends in the counterclockwise direction of each fountain-forming face (37*a*), (37*b*), (37*c*) serve as the ink channel-defining portions (38*a*), (38*b*), (38*c*) corresponding to the fountain-forming faces (37*a*) to (37*c*) respectively. The fountain-forming faces will be designated collectively by the reference numeral (37), and when there arises a need to make distinction, these faces will be referred to as first fountain-forming face (37*a*), second fountain-forming face (37*b*), and third fountain-forming face (37*c*) as arranged counterclockwise in order. Similarly, the ink channel-defining portions will be designated collectively by the reference numeral (38), and when there is a need for distinction, these portions will be referred to as first ink channel-defining portion (38*a*), second ink channel-defining portion (38*b*), and third ink channel-defining portion (38*c*) in the order of counterclockwise arrangement. The end face of the ink fountain member 2 is marked with the numerals 1 to 3 in corresponding relation with the ink channel-defining portions 38 to represent the respective portions 38.

A sheet moving device (40) for feeding and winding a strip of sheet (39) is arranged in the vicinity of the ink fountain member (2).

The sheet moving device (40) comprises a feed shaft (41), a take-up shaft (42), and a shaft driver (43) for driving the shafts (41), (42). The shaft driver (43) comprises an electric motor (44) for driving the feed shaft (41) and a power transmission mechanism (45) for transmitting the rotation of the motor (44) to the take-up shaft (42), where the feed shaft (41) rotates at a constant speed smaller than the rotation speed of the take-up shaft (42). A slide mechanism (47) that applies friction resistance and allows sliding is arranged at the power transmission mechanism (45). For example, the power transmission mechanism (45) includes gear trains, and the slide mechanism (47) is combined so that a first gear engaging with the gears on the motor (44) side and a second gear engaging with the take-up shaft (42) side overlap each other, and rotate while sliding with respect to each other with a predetermined friction resistance.

A core tube (48) of the sheet roll (49) in which a strip of sheet (39) made of plastic and the like is wound around the core tube (48) made of aluminum alloy and the like is removably fixed to the feed shaft (41). The sheet take-up member (50) of cylinder shape is removably fixed to the take-up shaft (42). Although not shown, a take-up tube made of plastic and the like is fitted to the outer periphery of the sheet take-up member (50) so as not to rotate with respect to each other.

The sheet (39) fed from the sheet roll (49) fixed to the feed shaft (41) is placed over the ink fountain member (2) so as to cover the fountain-forming face (37), and thereafter, guided to the take-up tube fitted to the sheet take-up member (50), where the distal end of the sheet (39) is fixed to the take-up tube by an appropriate means.

The relationship of the rotation speeds of the feed shaft (41) and the take-up shaft (42) is defined so that the movement speed of the sheet (39) at the portion of the sheet take-up member (50) is greater than the movement speed of the sheet (39) at the portion of the sheet roll (49) of the feed shaft (41) when assumption is made that sliding is not provided by the slide mechanism (47) even if the outer diameter of the sheet (39) wound around the sheet take-up member (50) is the smallest.

The sheet (39) is fed from the sheet roll (49), moved along the ink fountain member (2) in the longitudinal direction and wound by the sheet take-up member (50) by driving the feed shaft (41) and the take-up shaft (42) with the motor (44). Since the relationship of the rotation speeds of the feed shaft (41) and the take-up shaft (42) is defined as above, and the slide mechanism (47) is arranged between the motor (44) and the take-up shaft (42), the sheet (39) is moved while constantly being applied with tensile force. Thus, when the motor (44) is stopped, the portion of the sheet (39) covering the fountain-forming face (37) is held in intimate contact with the fountain-forming face (37).

Each fountain-forming face (37) of the ink fountain member (2) forms the ink fountain (1) when the ink fountain member (2) is positioned at the corresponding work position. In practice, the portion of the sheet (39) covering the fountain-forming face (37) and the outer peripheral surface of the fountain roller (3) form the ink fountain (1). The ink channel-defining portion (38) corresponding to the fountain-forming face (37) comes closer to the outer peripheral surface of the fountain roller (3) by way of the sheet (39), thereby forming an ink channel (52) between the portion of the sheet (39) in intimate contact with the ink channel-defining portion (38) and the outer peripheral surface of the fountain roller (3).

The size of the ink channel (52) is determined by the distance between the central axis of rotation of the fountain roller (3) and the central axis of rotation of the ink fountain member (2), the diameter of the fountain roller (3), and the distance from the central axis of rotation of the ink fountain member (2) to the ink channel-defining portion (38). In this example, three ink channel-defining portions (8) are different in distance from the central axis of rotation of the ink fountain member (2) to the ink channel-defining portion (38). The size of the ink channel thus differs depending on the work position.

A pair of right and left barrier plates (53) serving as the side plates of the ink fountain (1) are removably fixed in a space between the ink fountain member (2) and the fountain roller (3). Each barrier plate (53) has a substantially triangular shape. The portions corresponding to the two sides of the triangle are formed with a flat fountain member attracting face (53*a*) that is in intimate contact with the fountain-forming face (37) and a fountain roller attracting face (53*b*) having a concave portion of cylindrical surface shape that is in intimate contact with the outer peripheral surface of the fountain roller (3). Attracting permanent magnets (54) are fixed in an embedded manner in the vicinity of the two attracting surfaces (53*a*), (53*b*) of each barrier plate (53).

A barrier plate attracting portion (55) having the entire periphery made of magnetic material is arranged at two locations closer to both right and left ends on the outer periphery of the fountain roller (3), and the portions other than the attracting part (55) is made of non-magnetic material. The width of the attracting portion (55) is substantially the same as the width of the barrier plate (53). Each fountain-forming face (37) of the ink fountain member (2) may be entirely made of magnetic material or may have only the portion corresponding to the attracting portion (55) of the fountain roller (3) made of magnetic material and the remaining portion made of non-magnetic material.

The barrier plate (53) has the fountain roller attracting surface (53*b*) being in intimate contact with the attracting portion (55) of the fountain roller (3) and attracted thereto by magnetic force and the ink fountain attracting face (53*a*) being in intimate contact with the fountain-forming face (37) by way of the sheet (39) and attracted thereto by magnetic force so as to be fixed to the fountain roller (3) and the fountain-forming face (37), thereby forming the side plates of the ink fountain. The barrier plates (53) are merely attracted to the fountain roller (3) by magnetic force, and are therefore unlikely to cause trouble to the rotation of the fountain roller (3).

A cleaning tank (56) is disposed below and in front of the fountain roller (3). A cleaning blade (57) projecting obliquely backwardly upward from the upper end of the back wall of the tank (56) is fixed to the back part of the tank (56). The width in the right-to-left direction of the tank (56) and the blade (57) is greater than the length in the right-left direction of the fountain roller (3). The tank (56) and the blade (57) are moved forward and rearward by a reciprocating device (58) comprising an air cylinder, and is switched between a cleaning position at the back end where the upper end of the blade (57) is in pressing contact with the outer peripheral surface of the fountain roller (3) and a stand-by position at the front end where the blade (57) is away from the fountain roller (3).

A supporting table (59) of horizontal plate shape, which is long in the front-back direction, is disposed at the upper part on the right side of the frame (7), and a first barrier plate rest (60) on which new barrier plates (53) before use are mounted and a second barrier plate rest (61) on which barrier plates (53) after use are mounted are disposed on the upper surface of the support table (59). A first receiving part (62) having a convex portion of cylindrical surface shape for receiving the fountain roller attracting face (53*b*) of the barrier plate (53) and a second receiving part (63), projecting from the lower part of the first receiving part (62), for receiving the portion of the ink fountain attracting surface (53*a*) of the barrier plate (53) on the fountain roller attracting face (53*b*) side are disposed in each table (60), (61). A rod shaped magnetic member (64) is fixed in an embedded manner at the upper part of the first receiving part (62).

A container storage unit (66) for storing a plurality of ink containers (65) is disposed at the back part of the frame (7).

The ink container (65) comprises a container main body (67) made of flexible plastic. The container main body (67) has a bellows shape having a horizontal cross section of a circle and being compressible in vertical direction. The upper wall and the lower wall of the bellows shaped portion of the container main body (67) form a horizontal circular disc shape. A circular hole (68) is formed at the lower wall of the container main body (67), and the tubular portion (69) projecting downward from the peripheral edge of the hole (68) is integrally formed. A male thread is formed at the outer periphery of the tubular portion (69), and a bottom lid (70) of short cylinder shape is screw fit and fixed to the relevant portion from below. A circular hole (71) is formed in the bottom wall of the bottom lid (70). A bottom plate (72) of a thin circular disc shape made of plastic having a large elastic coefficient is fitted into the bottom lid (70), so that the outer peripheral edge of the bottom plate (72) is sandwiched between the bottom wall of the bottom lid (70) and the lower end face of the tubular portion (69) of the container main body (67). The portion of the bottom plate (72) facing the hole (71) of the bottom lid (70) constitutes the bottom wall of the container (65). The thickness of the bottom plate (72) becomes thinner towards the center, and a slit-like aperture (73) is formed in the bottom plate (72). In this example, six slit-like apertures (73) radially extending from the center of the bottom plate (72) are formed. A block (74) of short circular cylinder shape is integrally formed at the inner surface (lower surface) of the upper wall of the container main body (67). The outer diameter of the block (74) is slightly smaller than the inner diameter of the tubular portion (69), and the length (height) of the block (74) is slightly smaller than the length of the tubular portion (69).

Normally, different types of ink are accommodated in each container (65). The portion of the slit-like aperture (73) is closed when pressure is not applied to the upper portion of the container (65), whereby the ink will not be discharged to the outside through the closed aperture. As hereinafter described, when the upper portion of the container (65) is pressed downward with the bottom of the container (65) fixed, the slit-like aperture (73) portion opens by such pressure, and the ink in the container (65) drops downward through the portion of the opened slit-like aperture (73).

The container storage unit (66) comprises a support member (75) extending horizontally in the right-left direction. The right end of the supporting member (75) is supported by the back end of the supporting table (59) by way of a raising and lowering device (76) using an air cylinder. A plurality of container holders (77) are disposed in the right-left direction on the supporting member (75). Each container holder (77) comprises a bottom receiving part (78) for receiving the bottom of the container (65) from below, and a middle holding part (79) of substantially semicircular shape for holding the middle part of the container (65) as held by the back thereof.

A guide rail (80) extending horizontally in the front-back direction is disposed on the upper surface of the supporting table (59) at the portion on the right side from the barrier plate rests (60), (61), and the lower part on the right side of a first moving body (81) having a gate shape is guided by the guide rail (80). A roller (82) disposed at the lower part on the left side of the moving body (81) is placed on the upper surface of the left side portion of the frame (7). Although not shown, the moving body (81) is moved in the front-back direction by a driving device using the ball screw and the like.

A guide rail (83) extending horizontally in the right-left direction is disposed at the rear surface on the upper part of the first moving body (81), and a second moving body (84) is guided by the guide rail (83). Although not shown, the moving body (84) is moved in the right-left direction by a driving device using the ball screw and the like.

The main parts of a barrier plate replacing device (85) and an ink supply device (86) are disposed in the portion of the second moving body (84).

The barrier plate replacing device (85) is configured as below.

A cover (110) also used as a barrier plate stopper is disposed at a position close to the upper part of the fountain roller (3), the position being slightly backward from the back end of the barrier plate (53) attracted to the fountain roller (3) and the fountain-forming face (37). The cover (110) has both right and left ends fixed to the frame (7), and covers the entire length of the upper part of the fountain roller (3).

A third moving body (88) of horizontal plate shape is supported by the rear surface of the second moving body (84) by way of the raising and lowering device (87) using the air cylinder, and a pivoting/opening and closing device (89) using air pressure is disposed in the moving body (88). A pair of barrier-plate holding members (91) that freely opens and closes is disposed at the lower end of a vertical pivot shaft (90) projecting downward from the pivoting/opening and closing device (89). The holding member (91) is moved in the front-back direction and in the right-left direction by the movement of the first and second moving bodies (81), (84), and raised and lowered by the raising and lowering of the third moving body (88). The holding member (91) is pivoted about the center of the vertical axis by the pivot of the pivot shaft (90) by the pivoting/opening and closing device (89), and is opened and closed by the pivoting/opening and closing device (89).

The ink supply device (86) is configured as below.

A guide rail (92) extending horizontally in the right-left direction is disposed at the rear surface of the second moving body (84), and a pair of right and left container holding members (93) are guided by the guide rail (92). Each of the right and left holding members (93) is symmetric to each other in construction. A bottom holding part (94) for sandwiching the portion of the bottom lid (70) of the container (65) from both right and left sides and holding the outer periphery part of the bottom surface of the bottom lid (70) from below, and a middle holding part (95) for sandwiching and holding the middle part of the container (65) from both right and left sides are disposed in the holding members (93). Although not shown, each of the right and left holding members (93) is symmetrically moved and opened and closed by the driving device using air cylinder. A vertical raising and lowering rod (97) is supported in a freely raising and lowering manner at the portion of the bracket (96) extending upward from the upper part of the second moving body (84) and protruding horizontally above the holding members (93), and is raised and lowered by the raising and lowering device (98). A pressing member (99) of horizontal circular disc shape is fixed to the lower end of the raising and lowering rod (97) projecting downward from the bracket (96). A level sensor (101) for detecting the level of the ink in the ink fountain (1) is disposed at the distal end of the bracket (100) fixed to the bottom surface of the bottom holding part (94) of one holding member (93). An ultrasonic sensor or the like is used for the level sensor (101).

When the container (65) is held by the pair of holding members (93), the portion of the slit-like aperture (73) of the container (65) is closed and the ink will not be discharged to the outside if the pressing member (99) is not pressing downward the upper portion of the container (65). When the pressing member (99) presses the upper portion of the container (65) downward, the portion of the slit-like aperture (73) opens by the relevant pressure, and the ink drops downward. The ink drops on the outer peripheral surface of the fountain roller (3) slightly above the ink channel (52). The ink dropped onto the outer peripheral surface of the fountain roller (3) moves to the ink channel (52) by the rotation of the fountain roller (3), and retains in the ink fountain (1).

The level of the ink in the ink fountain (1) is detected by the level sensor (101) while reciprocating the ink supply device (86) to the left and the right at a predetermined speed, and the ink is supplied to the portion of the ink fountain (1) where the level of the ink is lower than a predetermined value, whereby the level of the ink in the ink fountain (1) is maintained substantially constant.

The barrier plate (53) is not attached to the fountain roller (3) and the fountain-forming face (37), and two or more new barrier plates (53) are mounted on the first barrier-plate rest (60) before starting printing. Furthermore, the container (65) is not held by the ink supply device (86), but the container (65) is held by the container holder (77). The portion of the middle part of the sheet (39) before use fed from the sheet roll (49) and wound around the sheet take-up member (50) is in intimate contact with the fountain-forming face (37) of the ink fountain member (2) positioned at a predetermined work position. In this case, the ink fountain member (2) is positioned at the first work position, and the sheet (39) is in intimate contact with the first fountain-forming face (37*a*).

In the circumstances described above, first, the barrier-plate holding members (91) of the barrier plate replacing device (85) holds one barrier plate (53) on the first barrier-plate rest (60), the barrier plate is attracted to one of the barrier plate attracting portion (55) of the fountain roller (3) and the fountain-forming face (37*a*) corresponding thereto, and thereafter another barrier plate (53) is similarly attracted to the other barrier plate attracting portion (55) of the fountain roller (3) and the fountain-forming face (37*a*) corresponding thereto.

Figure 8:
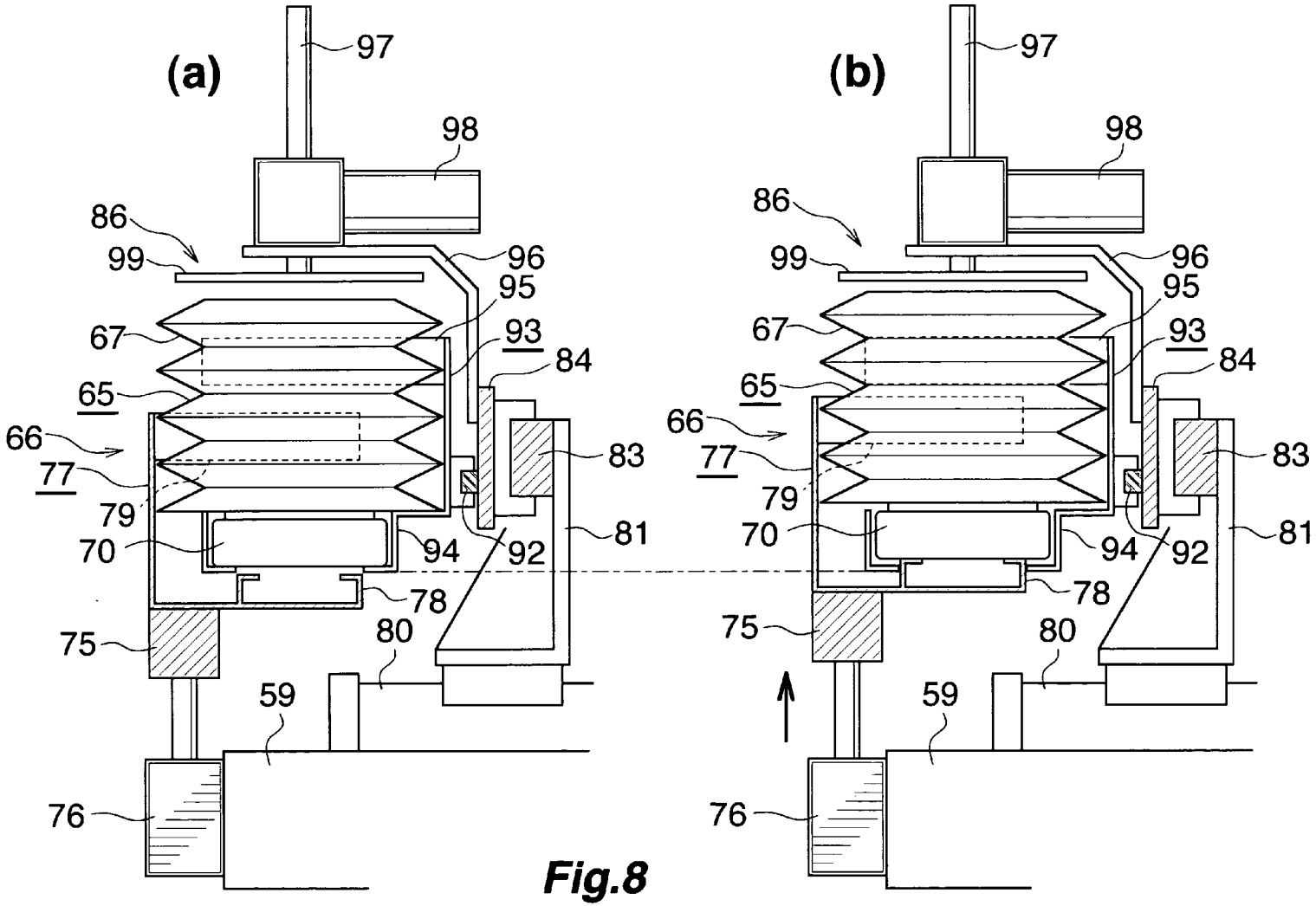
FIG. 8 is a side view showing the ink container and the portion of the ink supply device.
Figure 9:
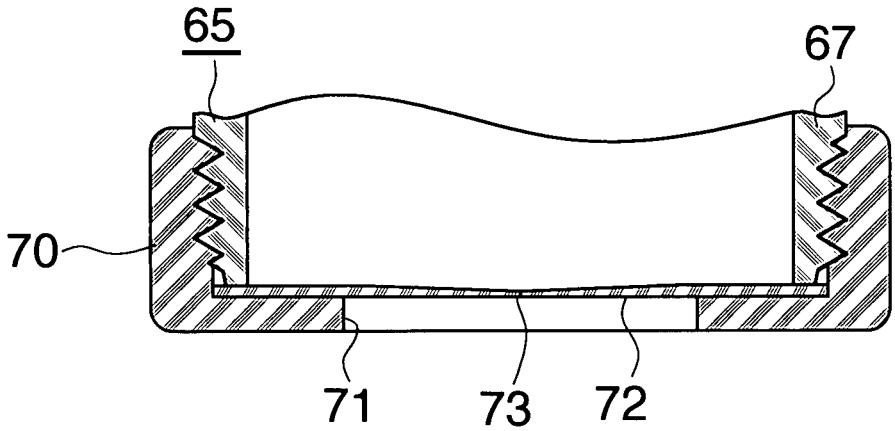
FIG. 9 is a longitudinal cross sectional view showing the bottom portion of the ink container in an enlarged manner.
Figure 10:
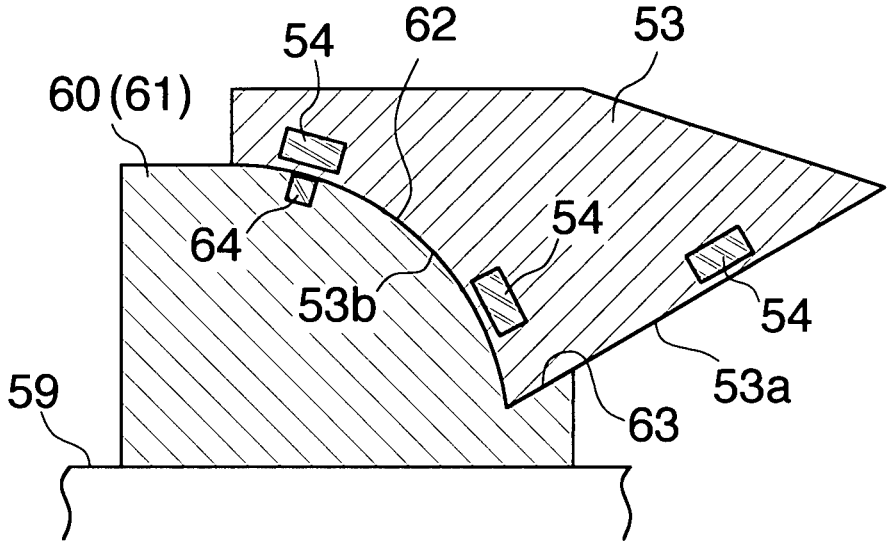
FIG. 10 is an enlarged traverse cross sectional view of a barrier plate rest.

Then, after the ink supply device (86) is moved in front of the desired container holder (77) of the container storage unit (66), the ink supply device (86) moves backward and holds the ink container (65) from the relevant container holder (77). When the ink supply device (86) moves backward towards the container holder (77), the pair of container holding members (93) is opened, the pressing member (99) is raised to the upper end position, and the support member (75) of the container storage unit (66), that is, the container holder (77) is raised to the upper end position, as shown in FIG. 8(*b*). The ink supply device (86) stops at the position where the container (65) is between the pair of container holding members (93), and the container holding members (93) close. FIG. 8(*b*) shows such a state. The container holder (77) lowers to the lower end position from such a state, whereby the container (65) is held by the container holding members (93), as shown in FIG. 8(*a*).

The ink supply device (86) moves forward away from the container holder (77) and moves above the ink fountain (1) when the container (65) is held by the container holding members (93). Subsequently, only the fountain roller (3) is rotated, and the ink is supplied to the ink fountain (1) up to a constant level while reciprocating the ink supply device (86) to the right and to the left with all the vibrating rollers (15) switched to the back end position. In this case, the level of the ink in the ink fountain (1) is made low, so that a small amount of ink retains only at a small portion in the vicinity of the ink channel (52).

After a constant amount of ink is retained in the ink fountain (1), the distributing roller (4) and other rollers are rotated, and the switching of the position of the vibrating roller (15) is controlled to supply the ink to the printing surface and perform printing.

During printing, the ink is supplied to the ink fountain (1) while moving the ink supply device (86) to the right and to the left, whereby the level of the ink in the ink fountain (1) is maintained substantially constant, and a small amount of ink is retained only at a small portion in the vicinity of the ink channel (52). Furthermore, a warning is given when abnormality in switching of the position of the vibrating roller (15) is detected by the output of the change-over detection sensor (102), and the operation is stopped.

When performing the next printing using a different ink after the printing is completed, the replacement procedure is performed in the following manner.

After printing is completed, the ink supply device (86) is first moved in front of the original container holder (77) of the container storage unit (66) and then moved backward to return the ink container (65) to the container holder (77). The ink supply device (86) stops at the position where the container (65) being held is positioned immediately above the bottom receiving part (78) of the original container holder (77). FIG. 8(*a*) shows such a state. In this state, the container holder (77) is stopped at the lower end position. The container holder (77) is raised to the upper end position when the ink supply device (86) is stopped. The container (65) is thus lifted by the bottom receiving part (78) of the container holder (77), as shown in FIG. 8(*b*), and a pair of container holding members (93) opens, and the ink supply device (86) moves forward and moves away from the container holder (77).

Meanwhile, all the vibrating rollers (15) are switched to the back end position to move away from the fountain roller (3), the cleaning tank (56) is switched to the cleaning position to press the blade (57) against the outer peripheral surface of the fountain roller (3), and the fountain roller (3) is rotated in this state. Similar to the time of printing, the ink remaining in the ink fountain (1) is thus applied to the outer peripheral surface of the fountain roller (3) through the ink channel (52), but such ink is scraped off by the blade (57) and collected in the tank (56). After all the ink remaining in the ink fountain (1) is taken out by the fountain roller (3) and collected in the tank (56) by the blade (57), the fountain roller (3) is rotated for a while in such a state. Since the ink remaining on the outer peripheral surface of the fountain roller (3) is mostly scraped off by the blade (57), the tank (56) is thereafter switched to the stand-by position to separate the blade (57) from the fountain roller (3), and the fountain roller (3) is stopped.

After the fountain roller (3) is stopped, the ink fountain member (2) is turned counterclockwise. When the ink fountain member (2) is turned, the fountain member attracting face (53*a*) of the barrier plate (53) is pushed and detached from the fountain-forming face (37*a*) by the ink fountain member (2), whereby the barrier plate (53) rotates counterclockwise together with the fountain roller (3) while being attracted to the fountain roller (3) but immediately contacts the cover (110) and stops. When the ink fountain member (2) is further turned, the barrier plate (53) turns about the abutting portion against the cover (110), and the fountain roller attracting face (53*b*) detaches from the outer peripheral surface of the fountain roller (3). The ink fountain member (2) is stopped with the barrier plate (53) detached from both the ink fountain member (2) and the fountain roller (3) and mounted thereon. When the ink fountain member (2) is stopped, the barrier-plate holding members (91) of the barrier plate replacing device (85) hold one of the barrier plates (53) and remove it from between the ink fountain member (2) and the fountain roller (3), and transfer the same to the second barrier-plate rest (61), and then similarly remove the other barrier plate (53) and transfer the same to the barrier-plate rest (61).

Figure 11:
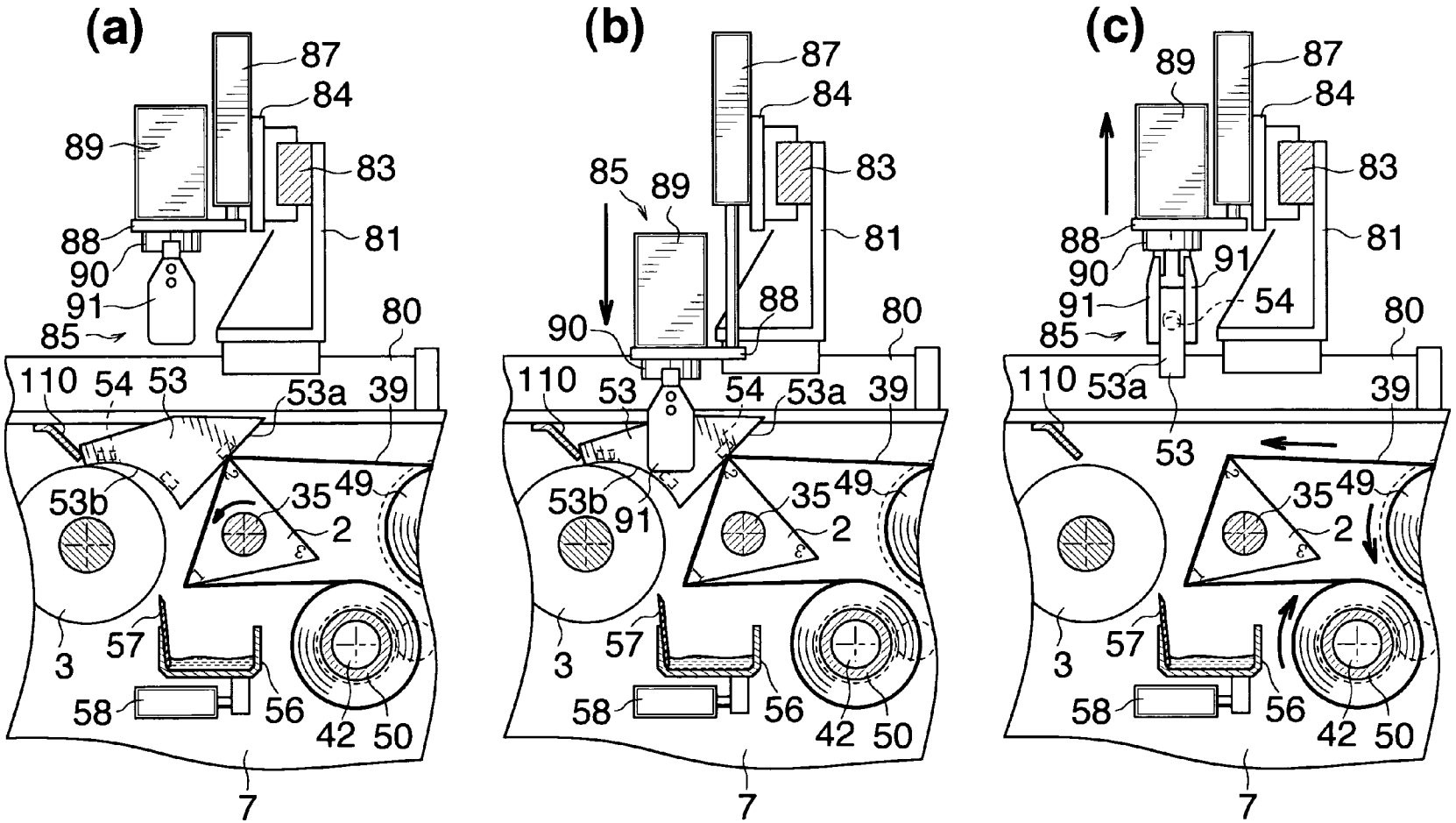
FIG. 11 is a side view showing the operation of a barrier plate replacing device.

The ink transferred to the vibrating roller (15) is transferred to the distributing roller (4) and other rollers by the rotation of the distributing roller (4), and the ink remaining on the outer peripheral surface of such rollers (15), (4) are also reduced. The vibrating roller (15), the distributing roller (4) and other rollers are automatically cleaned as in the prior art. In this case, the cleaning fluid for automatic cleaning can be transferred from the distributing roller (4) side to the fountain roller (3) to automatically clean the outer peripheral surface of the fountain roller (3) by switching the position of the vibrating roller (15) in either of the states as shown in FIG. 11, if necessary.

When the two barrier plates (53) are detached from between the ink fountain member (2) and the fountain roller (3), the sheet (39) of a predetermined length is fed from the sheet roll (49), and wound around the sheet take-up member (50) by the sheet moving device (40). The ink fountain member (2) is then positioned and stopped at the work position for the next printing. The portion of the used sheet (39) in intimate contact with the fountain-forming face (37*a*) during printing and attached with old ink is moved to a position deviated from the fountain-forming face (37), and the portion of the new sheet (39) before use is brought in intimate contact with the fountain-forming face (37).

Subsequently, the next printing is performed similarly to the above.

Figure 12:
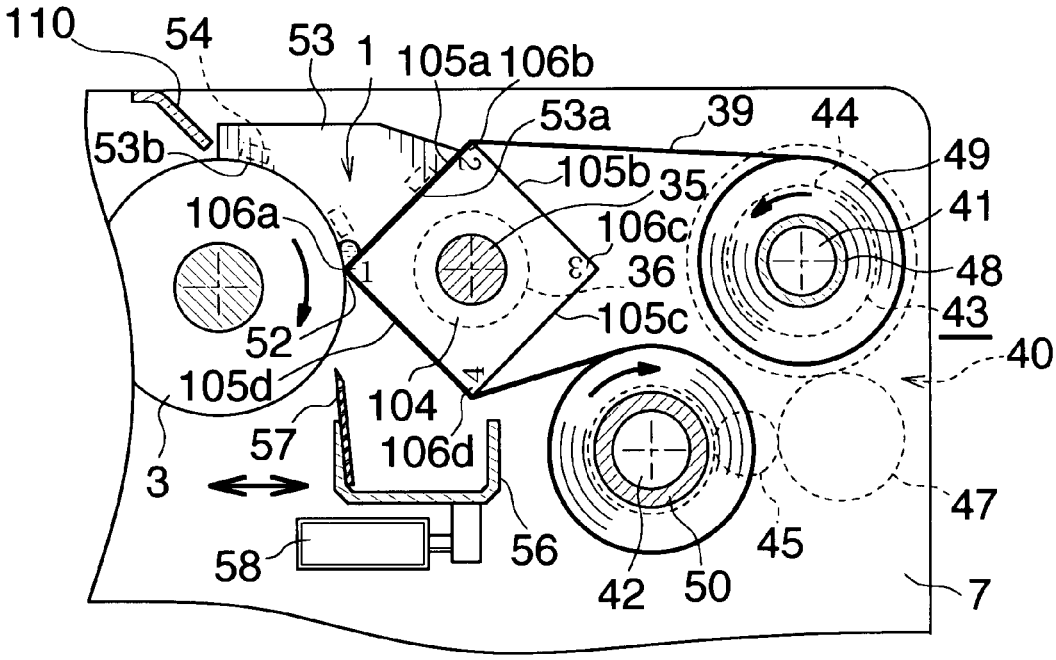
FIG. 12 is a view corresponding to FIG. 5 showing another embodiment of the ink fountain member.

FIG. 12 shows another embodiment of the ink fountain member.

In this case, the ink fountain member (104) has a quadratic prism shape having a cross section of square, and is positioned at four work positions at every 90 degrees and is fixed at each work position. The four side surfaces of the periphery of the ink fountain member (104) serve as fountain-forming faces (105*a*), (105*b*), (105*c*), (105*d*), and the ridge lines at the ends in the counterclockwise direction of each fountain-forming face (105*a*) to (105*d*) serve as the ink channel-defining portions (106*a*), (106*b*), (106*c*), (106*d*) corresponding to the ink forming surface (105*a*) to (105*d*) respectively.

Others are the same as the embodiment as mentioned first, and the same reference characters are denoted for the same components.

Figure 13:
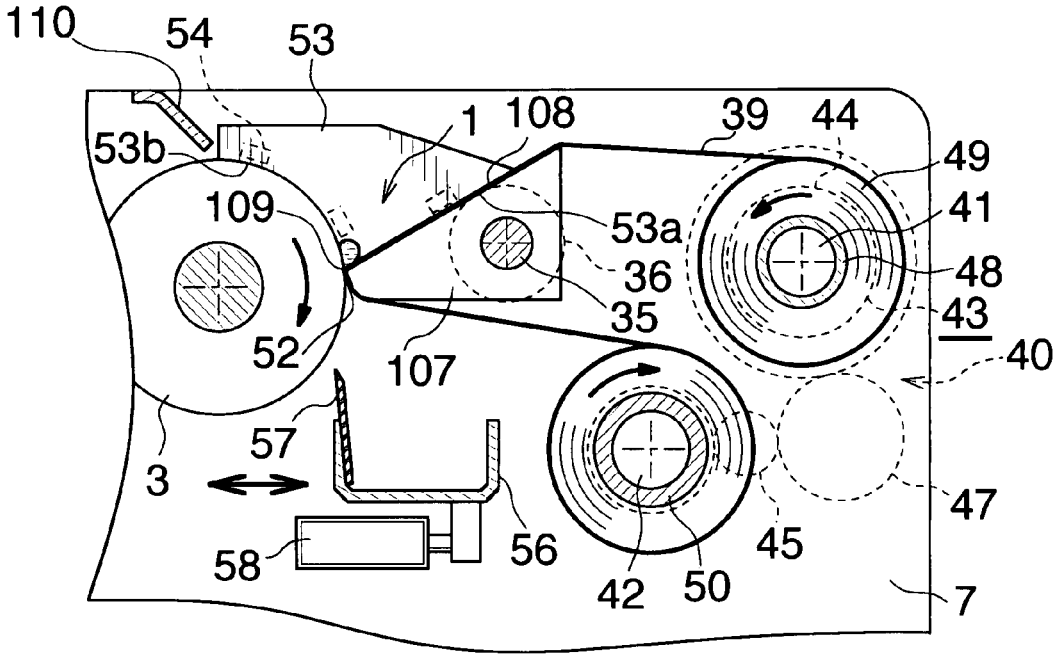
FIG. 13 is a view corresponding to FIG. 5 showing yet another embodiment of the ink fountain member.

FIG. 13 shows yet another embodiment of the ink fountain member.

In this case, the ink fountain member (107) has a triangular prism shape having a cross section of a right triangle, and is positioned and fixed at only one work position. The face extending obliquely rearwardly downward of the ink fountain member (107) serves as the fountain-forming face (108), and the ridge line at the back end (lower end) of the fountain-forming face (108) serves as the ink channel-defining portion (109). In time of replacing the barrier plate (53), the ink fountain member (107) is turned counterclockwise from the work position, and is returned to the work position after the barrier plate (53) is detached in a same manner as mentioned previously.

Others are the same as the above embodiment, and the same reference characters are denoted for the same components.

The entire configuration of the inking arrangement and the configuration of each part of the printing machine are not limited to the above embodiments, and may be appropriately changed.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

INDUSTRIAL APPLICABILITY

The present invention is suited for use in printing machines. Supply of ink from different types of ink container to the ink fountain is automated, and automation of further replacement procedure, simplification of replacement procedure, and reduction in time required for the replacement procedure are achieved by using the printing machine according to the present invention.

The invention claimed is:

1. A printing machine comprising:

an ink fountain member having a fountain-forming face forming an ink fountain;

an ink fountain roller for applying an ink to an outer peripheral surface through an ink channel between the ink fountain roller and the ink fountain member;

a plurality of rollers for supplying the ink applied to the outer peripheral surface of the ink fountain roller to a printing portion;

a frame of the printing machine that supports the ink fountain roller and the plurality of rollers;

a plurality of ink containers, accommodating different types of ink, a container storage unit for storing the plurality of ink containers, the container storage unit being disposed on the frame and having a raising/lowering device; and an ink supply device for holding the desired ink container and supplying the ink therein to the ink fountain, the ink supply device comprising a first moving body that moves in a horizontal direction orthogonal to the ink fountain roller and a second moving body that moves above the ink fountain in a direction parallel to the ink fountain roller, wherein the second moving body moves in the direction parallel to the ink fountain roller at the time of supply of the ink whereby the ink supply device supplies ink in the ink container to the ink fountain, and the first moving body moves in the direction orthogonal to the ink fountain roller at the time of replacement procedure whereby the ink supply device replaces a used ink container with a new ink container stored in the container storage unit, wherein each ink container comprises a container main body having a bellows shape compressible in the vertical direction and having a lower wall with a circular hole and a bottom plate of a thin circular disc shape disposed at the end of the container main body, an aperture that is normally closed is formed at a bottom wall of the container, the aperture being at least one slit in the bottom plate and at least a portion of the slit of the aperture is opened by pressure when the upper portion of the ink container is pressed downward while holding the bottom of the ink container so that the ink in the ink container passes through the opened aperture portion and drops downward, wherein the ink supply device further comprises, a pair of container holding members disposed on the second moving body and moved symmetrically in the direction parallel to the ink fountain roller to open and close, thereby automatically holding and releasing a portion including the bottom of the ink container and releasing the portion including the bottom of the ink container so that the ink container can move in a vertical direction, a pressing member disposed on the second moving body for pushing downward the upper portion of the ink container held by the container holding members, each of the container holding members being provided with a bottom holding part for sandwiching the bottom of the ink container and supporting the outer periphery part of the bottom surface of the ink container from below, a middle holding part for sandwiching and holding a middle part of the ink container, and wherein the container storage unit comprises a support member extending in the direction parallel to the ink fountain roller, and the supporting member is supported by the raising/lowering device for vertical motion so that by movement of the first and second moving bodies, the ink supply device can return and remove ink containers from the ink container storage unit, a plurality of container holders are disposed in the direction parallel to the ink fountain roller on the supporting member, and each container holder comprises a bottom receiving part for receiving the bottom of the ink container from below.

2. The printing machine according to claim 1, wherein a level sensor for detecting the level of ink in the ink fountain is disposed on the second moving body, the second moving body moving above the ink fountain in a direction parallel to the ink fountain roller, detecting the level of ink in the ink fountain, and supplying the ink to the portion of the ink fountain where the level of ink is lower than a predetermined value during printing operation.

3. The printing machine according to claim 1, wherein at a lower end adjacent the bottom wall, the ink container is tubular and defines a void, and further comprising a block mounted inside the ink container at an upper end, wherein the block is sized and configured to fit within the void so that the ink is substantially expelled when the pressing member reaches a lowest point.

4. The printing machine according to claim 1, wherein the bottom wall is a thin circular disc made of plastic having a large elastic coefficient.

5. The printing machine according to claim 4, wherein the bottom wall becomes thinner towards a center.

6. The printing machine according to claim 4, wherein the at least one slit is six radial slits extending from a center of the bottom wall.

7. A printing machine comprising:

an ink fountain member having a fountain-forming face forming an ink fountain;

an ink fountain roller for applying an ink to an outer peripheral surface through an ink channel between the ink fountain roller and the ink fountain member;

a plurality of rollers for supplying the ink applied to the outer peripheral surface of the ink fountain roller to a printing portion;

a plurality of ink containers, accommodating different types of ink, and being stored in a predetermined container storage unit that includes a raising/lowering device for moving the ink containers vertically; and an ink supply device for holding the desired ink container and supplying the ink therein to the ink fountain, the ink supply device comprising a first moving body across the ink fountain in a horizontal direction orthogonal to the ink fountain roller and a second moving body that moves above the ink fountain in a direction parallel to the ink fountain roller, wherein the second moving body moves in the direction parallel to the ink fountain roller at the time of supply of the ink whereby the ink supply device supplies ink in the ink container to the ink fountain, and the first moving body moves in the direction orthogonal to the ink fountain roller at the time of replacement procedure whereby the ink supply device replaces a used ink container with a new ink container stored in the container storage unit, wherein each ink container has a bellows shaped body depending from an upper portion, the bellows shaped body being compressible in the vertical direction, and a lower threaded tubular portion that is necked down with respect to the bellows shaped body, a bottom plate portion defining an aperture that is normally closed, and a bottom lid threadably engaging the lower threaded tubular portion to capture the bottom plate portion, the bottom lid supporting a portion of the bottom plate portion and defining a central hole surrounding the aperture of the bottom plate portion so that when at least a portion of the aperture is opened by pressure when the upper portion of the ink container is pressed downward while holding the bottom lid of the ink container, the ink in the ink container passes through the opened aperture portion and drops downward, wherein the ink supply device further comprises, a pair of container holding members disposed on the second moving body and moved symmetrically in the direction parallel to the ink fountain roller to open and close, thereby automatically holding and releasing the bottom lid of the ink container, and a horizontal pressing member disposed on a vertical rod supported by a bracket from the second moving body for selectively pushing downward the upper portion of the ink container held by the container holding members and, thereby, opening the aperture, wherein the vertical rod is connected to a motorized device for selectively lowering and raising the rod, wherein at the time of the replacement procedure, the second moving body moves to a predetermined position, the horizontal pressing member moves fully upward, the raising/lowering device moves fully upward, the pair of container holding members opens, and then the first moving body moves the pair of container holding members about a selected ink container of the plurality of ink containers so that the pair of container holding members can close about the selected ink container and the raising/lowering device can move fully downward so that the ink supply device may hold the selected container.

8. The printing machine according to claim 7, wherein the pressing member has a circular disc shape.

9. The printing machine according to claim 7, wherein a level sensor for detecting the level of ink in the ink fountain is disposed on the second moving body, the second moving body moving above the ink fountain in a direction parallel to the ink fountain roller, detecting the level of ink in the ink fountain, and supplying the ink to the portion of the ink fountain where the level of ink is lower than a predetermined value during printing operation.

10. The printing machine according to claim 7, wherein at a lower end adjacent the bottom wall, the ink container is tubular and defines a void, and further comprising a block mounted inside the ink container at an upper end, wherein the block is sized and configured to fit within the void so that the ink is substantially expelled when the pressing member reaches a lowest point.

11. The printing machine according to claim 7, wherein the bottom wall is a thin circular disc made of plastic having a large elastic coefficient.

12. The printing machine according to claim 11, wherein the bottom wall becomes thinner towards a center.

13. The printing machine according to claim 7, wherein the aperture is at least one slit in the bottom wall.

14. The printing machine according to claim 13, wherein the at least one slit is six radial slits extending from a center of the bottom wall.

15. The printing machine according to claim 7, wherein by closing the pair of container holding members and by lowering the container holder to a lower end position, when the ink supply device is positioned where the ink container is between the pair of container holding members, the ink container is to be held by the container holding members.

16. The printing machine according to claim 7, wherein after printing is completed, the ink supply device is first moved in front of the original container holder of the container storage unit and then moved back to return the ink container to the original container holder.

17. The printing machine according to claim 16, wherein by opening the pair of container holding members and by raising the container holder to an upper end position, when the ink supply device is positioned immediately above the bottom receiving part of the original container holder, the ink container is to be lifted by the bottom receiving part of the container holder.

18. The printing machine according to claim 7, wherein the container storage unit comprises a support member extending in the direction parallel to the ink fountain roller, and the supporting member is supported by the raising/lowering device, a plurality of container holders are disposed in the direction parallel to the ink fountain roller on the supporting member, and each container holder comprises a bottom receiving part for receiving the bottom of the ink container from below.

19. The printing machine according to claim 18, wherein by closing the pair of container holding members and by lowering the container holder to a lower end position, when the ink supply device is positioned where the ink container is between the pair of container holding members, the ink container is to be held by the container holding members.

20. The printing machine according to claim 18, wherein after printing is completed, the ink supply device is first moved in front of the original container holder of the container storage unit and then moved back to return the ink container to the original container holder.

21. The printing machine according to claim 20, wherein by opening the pair of container holding members and by raising the container holder to an upper end position, when the ink supply device is positioned immediately above the bottom receiving part of the original container holder, the ink container is to be lifted by the bottom receiving part of the container holder.

22. The printing machine according to claim 7, further comprising:

at least one barrier plate selectively fixed to the ink fountain;

a second raising/lowering device on the second moving body; and a pair of opposing plate holding members that open and close, wherein the second raising/lowering device and pair of opposing plate holding members are arranged so that the second moving body and second raising/lowering device selectively position the pair of opposing plate holding members to remove or replace the at least one barrier plate.

23. A printing machine comprising:

an ink fountain member having a fountain-forming face forming an ink fountain;

an ink fountain roller for applying an ink to an outer peripheral surface through an ink channel between the ink fountain roller and the ink fountain member;

a plurality of rollers for supplying the ink applied to the outer peripheral surface of the ink fountain roller to a printing portion;

a plurality of ink containers, accommodating different types of ink; and an ink supply device for holding a desired ink container and supplying the ink therein to the ink fountain, wherein the ink supply device comprises, a first moving body that moves in a horizontal direction orthogonal to the ink fountain roller, a first guide rail that guides the first moving body, a second moving body that moves above the ink fountain in a direction parallel to the ink fountain roller, a second guide rail that guides the second moving body and supported by the first guide rail, a pair of container holding members disposed on the second moving body and moved symmetrically in the direction parallel to the ink fountain roller to open and close, thereby automatically holding and releasing a portion including the bottom of the ink container and releasing the portion including the bottom of the ink container so that the ink container can move in a vertical direction, a pressing member disposed on the second moving body for pushing downward the upper portion of the ink container held by the container holding members, and a container storage unit for storing the plurality of ink containers, and the container storage unit comprises a support member extending in the direction parallel to the ink fountain roller, a raising/lowering device support the support member, and a plurality of container holders disposed on the supporting member in the direction parallel to the ink fountain roller.

24. The printing machine according to claim 23, wherein each container holder comprises a bottom receiving part for receiving the bottom of the ink container from below and a middle holding part for holding the middle part of the container as held by the back thereof, and each of the container holding members being provided with a bottom holding part for sandwiching the bottom of the ink container and supporting the outer periphery part of the bottom surface of the ink container from below, and a middle holding part for sandwiching and holding a middle part of the ink container as held by the front thereof.

* * * * *